US005125531A

United States Patent [19]

Wentz

[11] Patent Number: 5,125,531

[45] Date of Patent: Jun. 30, 1992

[54] CARRYING CASE FOR PERSONAL ARTICLES

[76] Inventor: Richard J. Wentz, 796 Terrace Dr., Los Altos, Calif. 94024

[21] Appl. No.: 703,213

[22] Filed: May 20, 1991

[51] Int. Cl.[5] ..... B65D 53/00

[52] U.S. Cl. ..... 220/344; 220/324; 206/811; 206/822

[58] Field of Search ..... 220/324, 334, 339, 344; 224/202, 207, 257, 909; 206/811, 822, 259, 570

[56] References Cited

U.S. PATENT DOCUMENTS

| | | | |
|---|---|---|---|
| 1,314,392 | 8/1919 | Glamzo | 206/811 X |
| 1,440,690 | 1/1923 | McMosiman . | |
| 1,466,548 | 8/1923 | Raney | 206/811 X |
| 1,522,633 | 1/1925 | Kister . | |
| 1,586,463 | 5/1926 | Paquette | 220/344 X |
| 1,631,371 | 6/1927 | Greubel | 206/259 X |
| 1,766,569 | 6/1930 | Von Frankenberg | 206/811 X |
| 1,809,696 | 6/1931 | Heilweil | 220/344 X |
| 1,961,181 | 6/1934 | Von der Heydt . | |
| 1,986,057 | 1/1935 | Hackworth . | |
| 1,989,527 | 1/1935 | Powers . | |
| 2,006,773 | 7/1936 | Moore . | |
| 2,081,930 | 6/1937 | Hoffman . | |
| 2,572,889 | 10/1951 | Strykower | 224/258 |
| 2,836,288 | 5/1958 | Atchison | 220/344 X |
| 3,081,867 | 3/1963 | Corey | 206/259 X |
| 4,905,857 | 3/1990 | Her . | |
| 4,969,587 | 11/1990 | Miller | 224/148 |

*Primary Examiner*—Stephen Marcus
*Assistant Examiner*—Nova Stucker
*Attorney, Agent, or Firm*—Townsend and Townsend

[57] ABSTRACT

An improved carrying case for personal articles wherein the case has a lower part and a cover hinged to the lower part. The lower part and cover forms a water-tight enclosure or case when a hasp releasably connects the outer end of the lower part to the cover. An inclined upper margin of the lower part carries a seal in a groove in the cover of the lower part. The concave outer surfaces for the case provide additional inner volume for containing a greater number of personal articles as well as the reinforcement of the case. An eyelet on the cover receives a nylon cord, string or thong so that the case can be worn around the neck. The hasp is of conventional design.

8 Claims, 3 Drawing Sheets

FIG.5
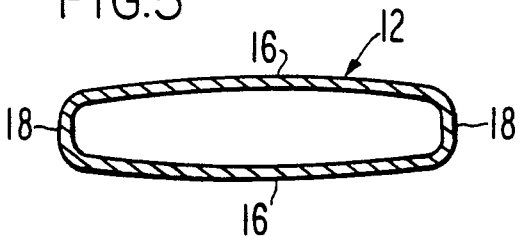
FIG.6
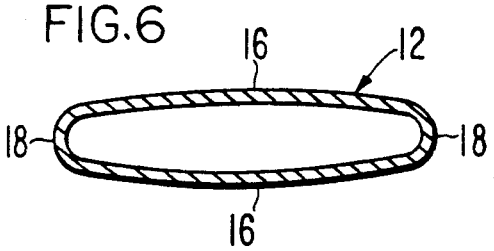
FIG.8
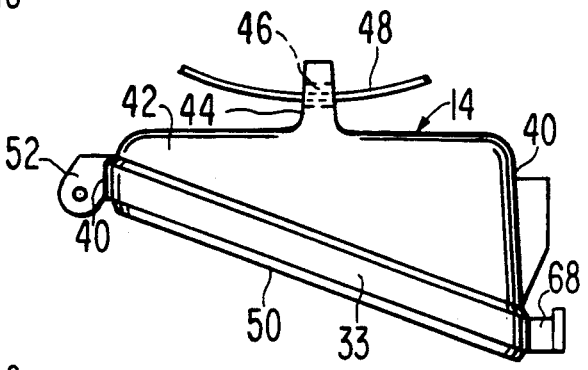
FIG.9
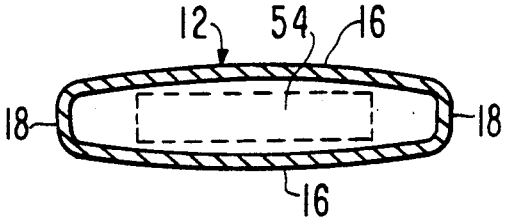
FIG.7
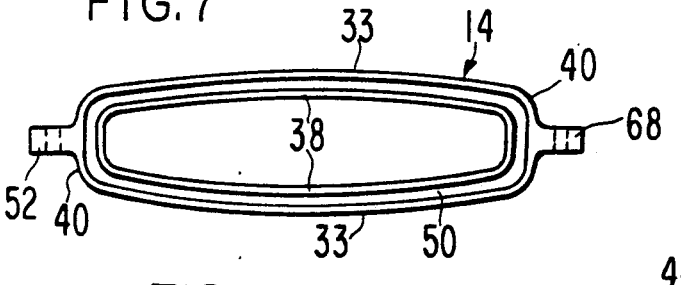
FIG.10
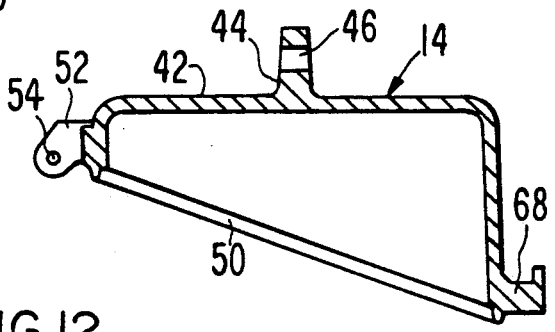
FIG.11
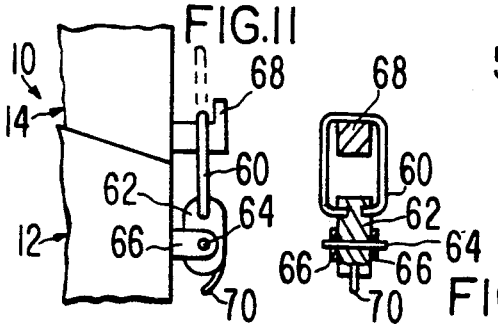
FIG.12

CARRYING CASE FOR PERSONAL ARTICLES

This invention relates to improvements-in article carrying cases for swimmers, beach walkers and the like and, more particularly, to a carrying case for personal articles which can be worn in the front of the body and suspended from the neck.

BACKGROUND OF THE INVENTION

Carrying cases for personal articles have been used in the past by swimmers, bathers and the like to allow the personal articles to be worn on the person. Thus, such articles are always available when they are needed and are secured against theft.

Disclosures relating to this general subject matter are found in the following U.S. patents:

| |
|---|
| 1,440,690 |
| 1,961,181 |
| 1,989,527 |
| 2,006,773 |
| 4,905,857 |
| 1,522,633 |
| 1,986,057 |
| 1,809,696 |
| 2,081,930 |

While some of the above disclosures describe waterproof features for carrying cases for personal articles, such disclosures relate to structures which are generally not satisfactory for one or more reasons. For instance, conventional cases have been made of materials which are relatively heavy in weight and are suitable to be worn anywhere except around the waist. In such a case, one or more walls of the case are shaped to fit the contour of a particular part of the body, such as the hip or stomach. An example of this feature is the carrying case as shown in U.S. Pat. 4,905,557 listed above.

In this patent, a cover is pivotally mounted on a hollow lower part one of the sidewalls of the case is relatively flat while the other sidewall is provided with a concave outer surface to fit the hip when a belt or band secures the case to the waist. No provision is made or suggested for receiving a cord, string or thong for wearing the case suspended from the neck. The patent 4,905,557 also shows a horizontal upper lip on the lower part of the case which is parallel to the bottom. This horizontal lip has a tendency to cause too much of the personal articles to project upwardly from the open top of the case when the case. Thus, such articles may easily fall out of the lower part when the case is opened. It is preferred that some means be provided to avoid this problem while maintaining a waterproof seal and structural strength in the upper and lower parts of the case.

SUMMARY OF THE INVENTION

The present invention is directed to an improved carrying case for personal articles to be worn around the neck wherein the case has a lower part and an upper part or cover hinged to the lower part. The upper and lower parts form a water-tight enclosure or case when a hasp releasably connects the outer end of the upper part to the lower part.

An important feature of the case of the present invention is the inclined upper margin of the lower part which carries a seal, such as an 0-ring seal, in a groove in the upper face of the lower part. The inclined upper margin of the lower part allows a greater portion of the case to be used for containing the personal articles. Thus, if the lower part were to be tipped over and to fall onto a surface when the case is opened, the personal articles will tend to remain in the case and not to be spilled out of the case, a feature which is significant when credit cards, keys and currency are part of the personal articles contained in the lower part of the case.

Another feature of the present invention is the provision of concave inner surfaces and convex outer surfaces for the sidewalls of the case to provide additional inner volume for containing a large number of personal articles as well as for reinforcement of the case to strengthen it against hard use. To this end, the lower and upper parts of the case can be made of synthetic resin plastics in a molding process to minimize the costs. Moreover, the ratio of the volume of the case with respect to its weight will be such that the case can be made so as to be floatable in water if such is deemed a desirable feature. For instance, the user in the water can always be assured that the case is secured around the neck if he feels an upward tug on the neck thong due to the buoyancy of the case.

Still another feature of the present is the use of an eyelet on the cover or upper part for receiving a flexible cord, string or thong of nylon or other material so that the case can be worn around the neck. The eyelet is made integral with the cover in a molding process. A hasp of conventional design is used to releasably close the cover or upper part on the lower part as the cover is pivotally secured at its opposite upper end to the uppermost point on the upper margin of the lower part.

The primary object of the present invention is to provide an improved carrying case for personal articles which can be worn suspended from the neck and which has a maximum inner volume yet the junction between the lower part and the cover is watertight when the case is closed.

Other objects of this invention will become apparent as the following specification progresses, reference being had to the accompanying drawings for an illustration of a preferred embodiment of the invention.

BRIEF DESCRIPTION OF THE DRAWINGS

FIGS. 5 and 6 are cross-sectional views taken along line 5—5 and 6—6 of FIG. 1;

FIG. 7 is a bottom plan view of the cover;

FIG. 8 is a side elevational view of the cover;

FIG. 9 is a view similar to FIG. 5, showing a personal article in dashed lines within the lower part of the case;

FIG. 10 is a vertical section through the cover;

FIG. 11 is an enlarged fragmentary side elevational view of a hasp for releasably interconnecting the cover and lower part; and FIG. 12 is a view of the hasp looking endwise thereof.

DETAILED DESCRIPTION OF THE DRAWINGS

Figure 1:
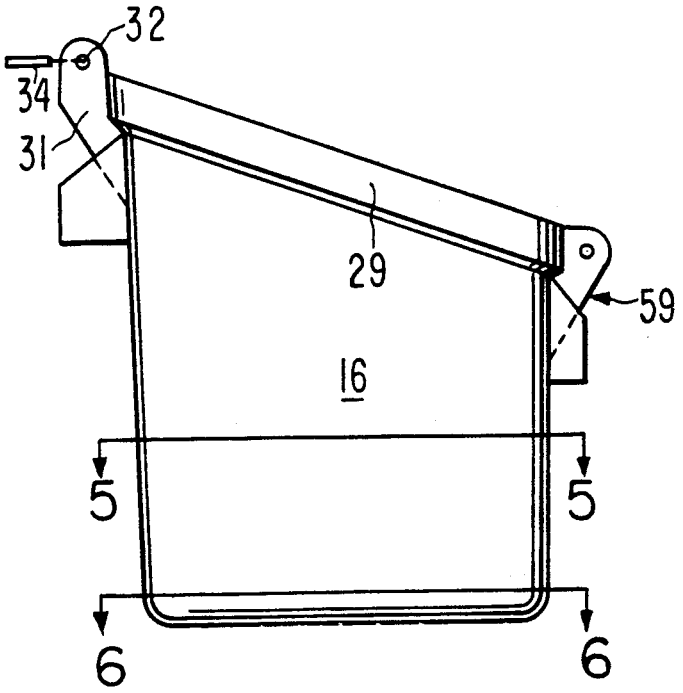
FIG. 1 is a side elevational view of the lower part of the case of the present invention.
Figure 1A:
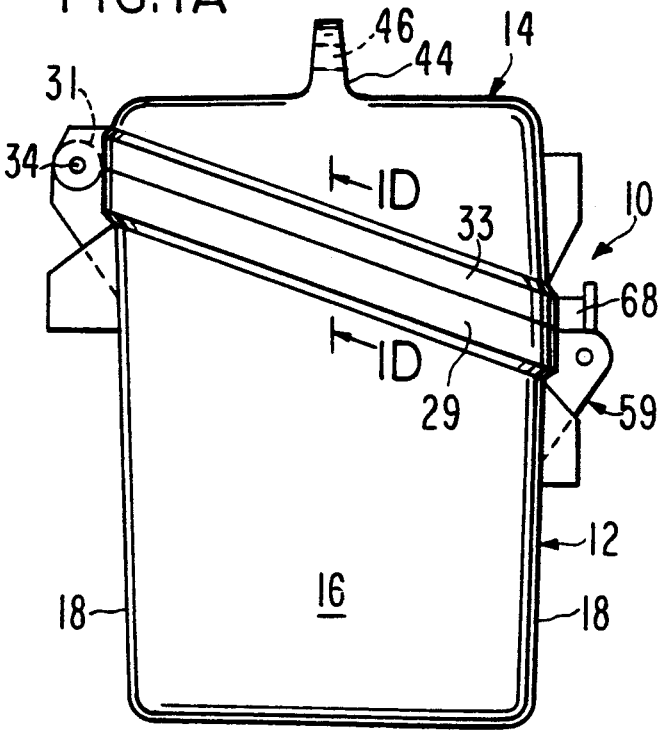
FIGS. 1A, 1B and 1C are side, end and top views of the case when the case is closed.
Figure 1C:
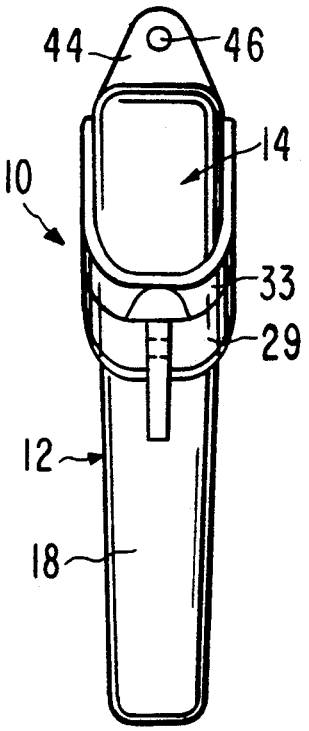
Figure 1B:
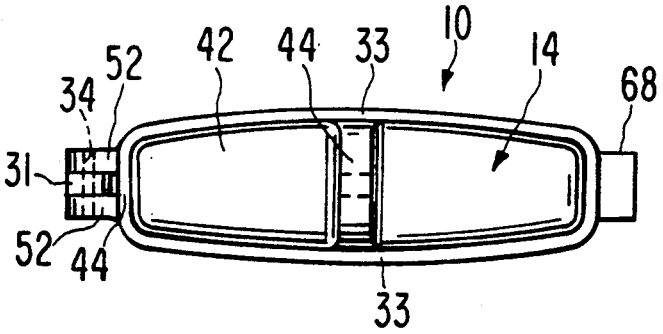
Figure 1D:
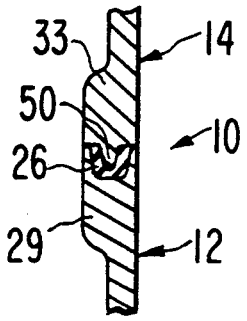
FIG. 1D is an enlarged, fragmentary cross-sectional view of a junction between the upper and lower parts of the case.

The case which is the preferred embodiment of the present invention is broadly denoted by the numeral 10 and is shown in FIGS. 1A, 1B and 1C. Case 10 has a lower, main part 12 which is hollow and has an open upper end. Lower part 12 is, in essence, a housing for containing personal articles, such as keys, drivers license, credit cards, coins, and the like. The lower part 12 is used with a cover or upper part 14 hingably mounted for movement to a position opening the upper end of lower part 12 to gain access to or to add articles to the interior of the lower part 12.

Figure 2:
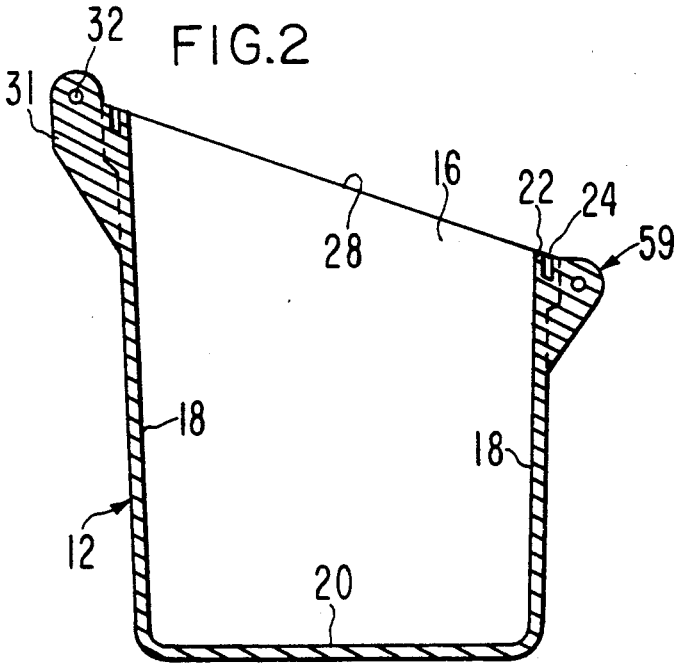
FIG. 2 is a vertical section through the lower part of FIG. 1.

Lower part 12 includes a pair of opposed sidewalls 16, a pair of opposed end walls 18, and a bottom wall 20 (FIG. 2). Walls 16, 18 and 20 are integral with each other and typically are formed in a molding process using a suitable plastic, such as a synthetic resin, which is generally light in weight and of high strength characteristics. A polycarbonate material is suitable for this purpose. One of the end walls 18 is longer than the other to provide an inclined upper margin 19 for lower part 12.

Sides 16, as shown in FIGS. 5 and 6, have convex outer surfaces. This configuration reinforces the side walls and increases the bending strength. The convex outer surface configuration of the sidewalls also provides additional space for receiving personal articles in the lower part 12 since the inner surfaces of the sidewalls 16 are essentially concave, at least slightly, to thereby render the sidewalls a greater distance apart than if the inner surfaces of the sidewalls were parallel with each other.

The upper margin of lower part 12, being inclined with respect to bottom wall 20 as shown in FIG. 2, provides additional space for personal articles received in the lower member. This feature also helps to keep the personal articles in the lower part in the event that the lower part 12 tips over and falls onto a surface when the case 10 is open.

Figure 4:
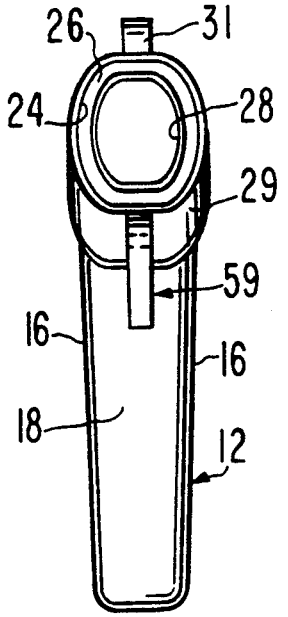
FIG. 4 is a view similar to FIG. 3 but showing the opposite end of the lower part.

The upper margin 19 of lower member 12 has a generally flat face 22 as shown in FIG. 2. A continuous groove 24 extends into face 22 and receives an 0-ring 26 (FIG. 4). The 0-ring acts as a seal, rendering the case watertight when the cover is on the lower part and the case is closed. The O-ring surrounds the top opening 28 (FIG. 4) of lower part 12. Personal articles pass into and out of the lower part through opening 28. Typically, the angle of the upper margin of lower member 12 relative to bottom 20 is in the range of 15° to 30°.

An added band or reinforcement strip 29 extends around the upper margin 19 of lower part 12 and serves to widen the upper margin 19 and allows groove 24 to be formed in face 22. This feature permits the sidewalls 16 of lower part 12 to be relatively thin while being relatively strong. Similarly, cover 14 has a widening strip 33 at its lower margin.

Figure 3:
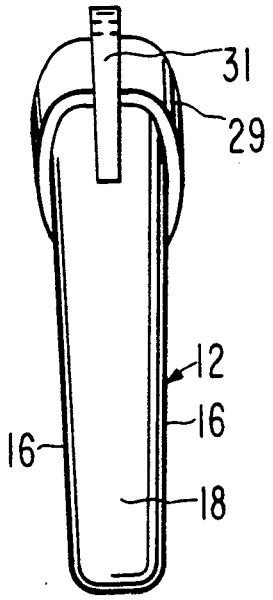
FIG. 3 is an end elevational view of the lower part looking from left to right in FIG. 1.

An ear 31 is rigid up to the longer end wall 18 as shown in FIG. 1. Ear 30 has a central hole 32 for receiving a pin 34 (FIG. 3) for the purpose of pivotally interconnecting lower part 12 and cover or upper member 14 shown in FIGS. 7, 8 and 10.

Cover 14 includes a pair of opposed sidewalls 38 (FIG. 7), a pair of opposed end walls 40 and a top wall 42 (FIG. 10). Walls 38, 40 and 42 are integral with each other and are formed from a molding process using the same material as that found in lower part 12.

Cover 14 has an eyelet 44 with a hole 46 therethrough for receiving a cord, string or thong 48 (FIG. 8) for use in coupling the case 10 to the neck when the case is to be worn on the person.

The lower margin 21 of cover 14 is inclined and is parallel with the inclined upper margin 19 of lower member 12. Thus, when the cover is in closed relationship to the lower part 12, the cover and lower parts appear as shown in FIG. 1A.

A continuous rib 50 is on the lower margin of cover 14 and is adapted to engage the O-ring 26 on lower member 12 in the manner shown in FIG. 10 when the case is closed. Thus, rib 50 in watertight and in sealing engagement with the O-ring. Rib 50 distorts the O-ring (FIG. ID) and prevents water from seeping into the case at the junction between the upper and lower margins 19 and 21 of lower member 12 and cover 14.

The shorter end wall 40 of cover 14 has an ear 52 (FIG. 7) provided with a hole 54 therethrough for receiving pin 34 (FIG. 3) for interconnecting ears 31 and 52 to pivotally interconnect the cover 14 and lower part 12. Thus, the cover can move into and out of closing relationship to the lower member 12 and, when in closing relationship with the lower part, the cover seals the junction between the cover and lower part by virtue of the fact that rib 50 (FIG. 10) of the cover engages the O-ring 26 in the manner shown in FIG. 10.

FIG. 9 shows a personal articles, such as a number of credit cards 54, in lower part 12 to reverse the way in which the personal articles take up the space within the lower part.

Once the case is closed, any suitable releasable locking means can be used to releasably lock the cover to the lower part. To this end, a conventional hasp 59 can be provided, the hasp 59 including an inverted U-shaped element 60 pivotally carried at the ends thereof by a follower 62 pivotally mounted by means of a pin 64 on the outer end of a projection 66 secured to the shorter end wall 18 of lower part 12. The element 60 is adapted to hook over a projection 68 on the longer end wall 40 of cover 14.

Follower 62 is mounted for movement from a position in which the crossbar of the element 60 is in the locked position of FIGS. 11 and 12 to the unlocked position which the crosspiece is in the dashed line position of FIG. 11. When the crosspiece is in the dashed line position of FIG. 11, the element 60 can be moved off projection 68 and the cover 31 can be opened. A finger 70 is provided on follower 62 to provide for manual movement of the follower relative to the case. Any other suitable type of releasable locking means can be used, if desired, in place of the hasp.

In use, cover 14 is pivotally mounted by pin 34 on ear 31 by virtue of the fact that the pin 34 passes through holes 32 and 54 of ears 31 and 52 of lower part 12 and cover 31. The cover can move into closing relationship to the upper open end of the lower part 12 in which case the lower margin of cover 14 is in substantial abutment at the interface with the upper margin of lower part 12, and rib 50 will engage O-ring seal 26 in the manner shown in FIG. 13. The hasp shown in FIGS. 11 and 12 is then used to releasably couple projection 68 on cover 14 to the inverted U-shaped element 60 pivotally carried on the upper part of the shorter end wall 18 of lower part 12. Thus, the case, when closed, can carry personal articles of different types in a watertight housing and the closed case can be worn suspended from the neck by use of the thong 48 (FIG. 8).

What is claimed is:

1. A device for carrying personal articles comprising:

a case having a lower hollow part and an upper part, said upper part defining a hollow cover, said lower part having an inclined upper margin and an open upper end and said cover having an inclined lower margin and an open lower end aligned with the open upper end of the lower part when the cover is in closing relationship to the open upper end of the lower part;

means pivotally mounting the cover on the lower part near the upper extremity of the upper margin thereof of permit the case to be opened and closed, said case having a pair of sidewalls, said sidewalls being provided with convex outer surfaces;

a seal at the junction of the lower part and the cover; and means coupled with said lower part and the cover near the lower extremity of the upper margin of the lower part for releasably locking the cover to the lower part when the case is closed.

2. A device as set forth in claim 1, wherein said seal comprises an O-ring on one of the parts and a continuous rib on the other part, said rib being in sealing engagement with the O-ring seal when the case is closed.

3. A device as set forth in claim 2, wherein the rib is on the cover, said lower part having a flat upper surface provided with a continuous groove therein, said O-ring seal being in the groove.

4. A device as set forth in claim 1, further comprising band means on the upper margin of the lower part and the lower margin of the cover said band means projecting laterally from the upper and lower parts, said upper margin of the lower part having a continuous groove therein, said seal comprising an O-ring in the groove, the lower margin further including a continuous rib, said rib being in sealing engagement with the O-ring seal when the case is closed.

5. A device as set forth in claim 1, wherein each of the lower and upper parts has a pair of opposed sidewall segments, each pair of sidewall segments of said lower part and said cover having convex outer surfaces.

6. A device as set forth in claim 1, wherein each sidewall of said lower part and said cover includes a concave inner surface.

7. A device as set forth in claim 1, wherein said cover has a top surface, there being an eyelet coupled with said top surface, and a cord means for coupling the eyelet around the neck.

8. A device as set forth in claim 1, wherein said lock means includes a hasp.

* * * * *